United States Patent [19]

Scherrer

[11] Patent Number: 5,029,422

[45] Date of Patent: Jul. 9, 1991

[54] FALSE CEILING CONSTITUTED BY A TAUT SHEET FASTENED, ALONG ITS EDGES, TO A SUPPORT FIXED TO THE WALLS OF A ROOM OF A BUILDING

[76] Inventor: Fernand Scherrer, 2 Rue Georges Bizet, 68170 Rixheim, France

[21] Appl. No.: 340,231

[22] Filed: Apr. 19, 1989

[30] Foreign Application Priority Data

Apr. 22, 1988 [FR] France ..... 88 05392

[51] Int. Cl.[5] ..... E04B 1/00

[52] U.S. Cl. ..... 52/222; 160/392

[58] Field of Search ..... 52/222; 24/455–462; 160/395, 368, 327, 392–397

[56] References Cited

U.S. PATENT DOCUMENTS

| | | | |
|---|---|---|---|
| 3,205,628 | 9/1965 | Frisk | 52/222 |
| 4,625,490 | 12/1986 | Baslow | 52/222 |
| 4,731,960 | 3/1988 | Sease | 52/222 |
| 4,788,806 | 12/1988 | Sease | 52/222 |

FOREIGN PATENT DOCUMENTS

| | | | |
|---|---|---|---|
| 43466 | 1/1982 | European Pat. Off. | 52/222 |
| 2820731 | 11/1978 | Fed. Rep. of Germany | 52/222 |
| 2202997 | 10/1973 | France . | |
| 2228923 | 12/1974 | France | 52/222 |
| 2310450 | 3/1976 | France . | |
| 2597906 | 10/1987 | France . | |
| 464490 | 12/1968 | Switzerland | 52/222 |
| 2051914 | 1/1981 | United Kingdom | 52/222 |

*Primary Examiner*—Henry E. Raduazo

*Attorney, Agent, or Firm*—McAulay, Fisher, Nissen, Goldberg & Kiel

[57] ABSTRACT

This invention relates to a false ceiling, constituted by a taut sheet fastened, along its edges, to a support fixed to the walls of a room, said false ceiling being characterized in that the rail presents a downwardly open recess, defined by two vertical flanges of different heights, namely a first flange of small height and a second flange of greater height and extending downwardly further than the first flange, and in that the first flange, of small height, of the rail terminates, at its lower end, in a shoulder extending horizontally in the direction of the second flange of greater height and stopping at a distance therefrom in order to define, between the second flange and the shoulder, a passage allowing the introduction of the harpoon, forming the edge of the taut sheet, upwardly in the recess.

20 Claims, 3 Drawing Sheets

FALSE CEILING CONSTITUTED BY A TAUT SHEET FASTENED, ALONG ITS EDGES, TO A SUPPORT FIXED TO THE WALLS OF A ROOM OF A BUILDING

FIELD OF THE INVENTION

The present invention relates to a false ceiling constituted by a taut sheet fastened, along its edges, to a support fixed to the walls of a room of a building.

BACKGROUND OF THE INVENTION

False ceilings are already known, which comprise, on the one hand, a horizontal frame fixed to the upper part of the walls of a room, this frame being formed by an outer rail, itself constituted by butt-jointed sections, and, on the other hand, a sheet stretched horizontally within this frame, this sheet being constituted by a sheet of plastics material or cloth. The sheet is maintained taut due to the fastening, on the rail, of a border fast with the sheet, forming to some extent a "harpoon", this border presenting in cross section the shape of a hook gripping on a shoulder of the rail.

Heretofore known false ceilings, although they incontestably improve the aesthetics of the rooms in which they are installed, nonetheless present the drawback of leaving visible, all around the room, the lower part of the rail serving for their fastening.

It is an essential object of the present invention to overcome this drawback by providing a false ceiling of which the sheet is fastened to the rail forming support so as totally to hide the fastening rail and considerably to facilitate positioning of the border of the taut sheet on its retaining shoulder.

SUMMARY OF THE INVENTION

To that end, this false ceiling, constituted by a taut sheet fastened, along its edges, to a support fixed to the walls of a room, this support being constituted by a continuous rail presenting a shoulder on which is fastened a border of the sheet, in the form of a hook or "harpoon", is characterized in that the rail presents a downwardly open recess, defined by two vertical flanges of different heights, namely a first flange of small height adjacent a wall and a second flange of greater height, located towards the interior of the room and extending further downwardly, and in that the first flange, of small height, of the rail terminates, at its lower end, in a shoulder extending horizontally in the direction of the second flange of greater height and stopping at a distance therefrom in order to define, between the second flange and the shoulder, a passage allowing the introduction of the harpoon upwardly in the recess so that this harpoon can fasten on the horizontal shoulder, in simple abutment thereon, the horizontally stretched sheet thus being deviated upwardly, penetrating in the recess of the rail, abutting beneath the lower end of the second flange.

BRIEF DESCRIPTION OF THE DRAWINGS

The invention will be more readily on reading the following description with reference to the accompanying drawings, in which.

DETAILED DESCRIPTION OF THE DRAWINGS

Figure 1:
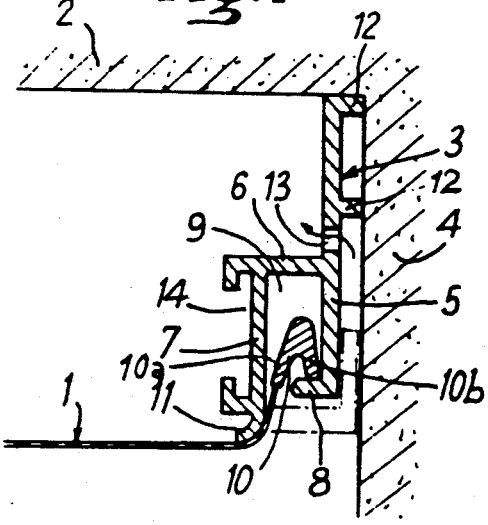
FIG. 1 is a partial vertical sectional view of a false ceiling according to the invention, comprising a rail fixed to the upper part of a wall of a room.

Referring now to the drawings, FIG. 1 shows the end part of a false ceiling according to the invention which is constituted by a sheet 1 stretched horizontally below the ceiling 2 of a room. This sheet 1 is fixed, along its edges, to a support constituted by a horizontal rail 3 itself fixed to the upper part of a wall 4 of the room by appropriate means (not shown) such as screws. This rail 3 comprises an outer vertical flange 5 which extends parallel to the wall 4 and in the immediate proximity thereof. From this outer vertical flange 5 projects, approximately half way up, an upper horizontal web 6 extending over a short distance, for example of the order of 7 millimeters, towards the interior of the room. This web 6 extends, at its end, by an inner vertical flange 7 extending downwardly slightly more than the outer flange 5 close to the wall 4. The outer flange 5 presents, at its lower end, a shoulder 8 extending horizontally towards the interior of the room, over a short distance, for example 3 millimeters. This shoulder 8 at right angles advantageously presents a rounded end. The lower part of the outer vertical flange 5, the upper horizontal web 6 and the inner vertical flange 7 constitute a downwardly open recess 9 in which is engaged a harpoon 10 constituting the border of the taut sheet 1. This harpoon 10 which is advantageously made of semi-supple extruded plastics material, presents, in cross section, the shape of a hook extending towards the wall 4 and downwardly open. It comprises an inner arm 10*a* by which it is connected to the sheet 1 and an outer arm 10*b* which is curved downwardly. The harpoon 10 abuts, when the sheet 1 is taut, on the shoulder 8, by the lower end of its outer arm 10*b* which extends downwardly.

As may be seen in FIG. 1, the sheet 1 penetrates in the recess 9 of the rail 3, abutting beneath the rounded lower end part 11 of the inner flange 7. Consequently, the sheet 1 slides on this rounded part 11 without risk of being damaged. Furthermore, it should be noted that the harpoon 10 is simply in abutment on the horizontal lower shoulder 8, by its outer arm 10*b*, and consequently it is much easier to place in position of fastening. It suffices in fact to push the harpoon 10 upwardly, by means of an appropriate tool, such as a spatula, engaged in the harpoon 10, to pass it between the shoulder 8 and the vertical flange 7 and guide it above the shoulder 8. When the harpoon 10 is released, it then comes into abutment against the shoulder 8 by itself, thus ensuring a perfect hold of the taut sheet.

Due to the small width of the rail 3, there exists between the curved part of the sheet 1 which is in contact with the rounded end 11 and the wall 4, a space as shown in FIG. 1, which, however, may possibly be closed by a finishing clip in the form of a bracket as indicated in broken lines in FIG. 1. This clip is held in place by any appropriate means, for example by simple force-fitting of its vertical flange between the outer vertical flange 5 of the rail 3 and the wall 4. This vertical flange 5 is advantageously maintained spaced apart from the wall 4 by means of projections 12 provided in the upper part of its face turned towards the wall 4 and such spaced apart relationship allows the circulation of air and the passage of this air in the space between the taut sheet 1 and the ceiling 2, openings 13 being provided to that end in the outer vertical flange 5 of the rail 3, below the projections 12 and above the web 6.

The rail 3 preferably comprises, on the inner face of the inner vertical flange 7, i.e. opposite recess 9, a groove 14 of C-shaped cross section. This groove is adapted to receive an arm of a connecting bracket, in each corner of the wall, in order to assemble together two rails 3 perpendicular to each other, or a flat portion to ensure perfect join of butt-jointed rails.

Figure 2:
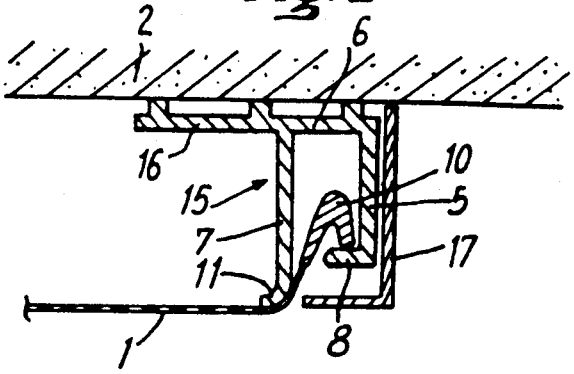
FIG. 2 is a view in vertical section of a variant embodiment of the rail fixed to the ceiling of a room.

In the variant embodiment shown in FIG. 2, the false ceiling according to the invention comprises a rail 15 which is fixed to the ceiling 2 of the room. To that end, the vertical flange 5 stops at the level of the horizontal web 6 of the rail 15 and this web is extended laterally above the sheet 1, i.e. beyond the vertical flange 7, by a horizontal flange 16. The web 6 and the flange 16 are fixed to the ceiling in any appropriate manner, for example by means of screws engaged therein. The upper horizontal web 6 is extended downwardly, as in the case of the embodiment of FIG. 1, by the two flanges 5 and 7, the vertical flange 5, of smaller height, terminating at its lower end by the horizontal shoulder 8 on which abuts the harpoon 10 constituting the border of the sheet 1. In this embodiment of the invention, the outer part of the rail 15, i.e. the shoulder 8 and the flange 5, may be hidden by an added finishing bracket 17 which is fixed to the rail 15 by any appropriate means, for example by means of a double-face adhesive tape or a clipping device, etc...

Figure 3:
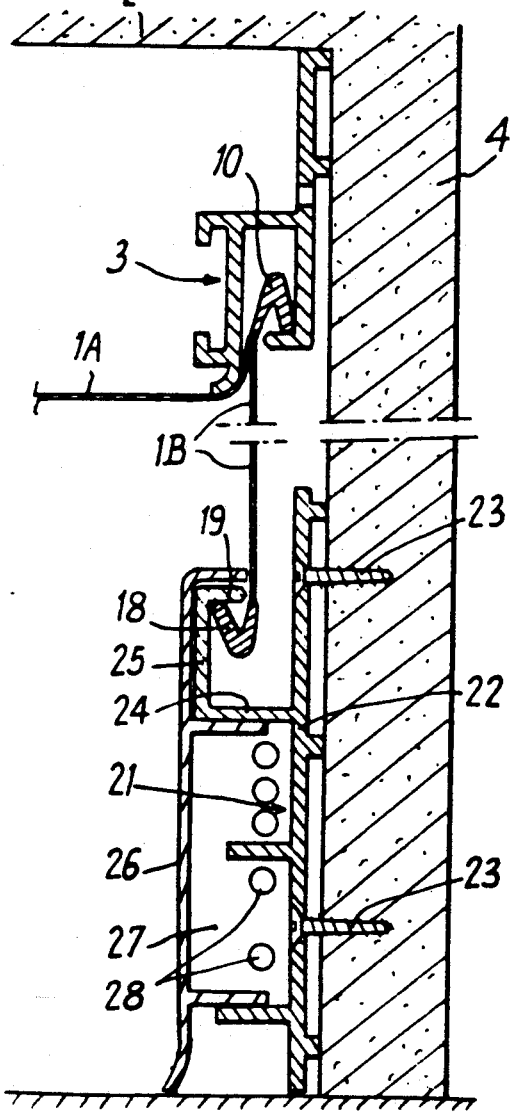
FIG. 3 is a view in vertical section of upper and lower rails fixed to a wall of a room for holding two taut sheets constituting, respectively, a false ceiling and a false wall.

FIG. 3 illustrates the production, in the same room, of a false ceiling by means of a horizontal taut sheet 1A and of a false wall by means of a vertical taut sheet 1B, these two sheets being joined to each other at the top of the room and being fast at that point with a common border in the form of a harpoon 10. This harpoon 10 is fastened to a rail 3 fixed to the upper part of the wall 4 of the room and the vertical taut sheet 1B forming the false wall is fast with a lower horizontal border 18 in the form of a harpoon which is fastened beneath a shoulder 19 of a base plinth 21 fixed to the lower part of the wall 4. It should be noted that the lower harpoon 18 is reversed with respect to the upper harpoon 10, i.e. it extends towards the interior of the room and is upwardly open. The plinth 21 comprises a vertical web 22 fixed to the wall by means of screws 23 for example and this vertical web 22 is extended, in its upper part, by a horizontal flange 24 extending towards the interior of the room, which is in turn extended by a vertical flange 25 extending upwardly and to which is joined the shoulder 19 extending in the direction of the vertical web 22. The base plinth 22 is covered with another added plinth 26, made of plastics material, light alloy or any other material, fixed for example by clipping, which defines, with the base plinth 22 fixed to the wall, a compartment 27 in which are housed electrical cables 28, etc...

Figure 4:
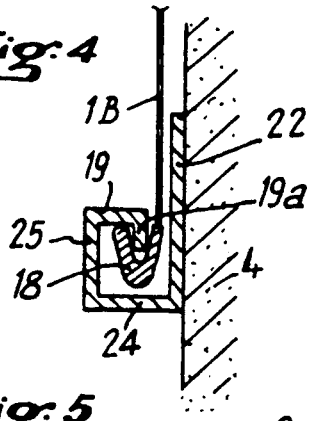
FIG. 4 is a view in vertical, transverse section of a rail used for fastening the lower border of a vertical taut sheet constituting a false wall.

In the variant embodiment of the invention shown in FIG. 4, the vertical taut sheet 1B constituting the false wall is fastened, by its harpoon 18 constituting its lower border, to a rail presenting characteristics similar to those of the rail forming the upper part of the plinth 21 of FIG. 3. More particularly, the rail for fastening the harpoon 18 comprises the vertical web 22, limited in its upper part, which is fixed to the wall and is extended, as in the embodiment of FIG. 3, by the horizontal and vertical flanges 24 and 25 respectively and by the horizontal shoulder 19. This shoulder 19 is also bent downwardly at right angles in order to constitute, at its end, a flange 19*a* beneath which the harpoon 18 hooks.

Figure 5:
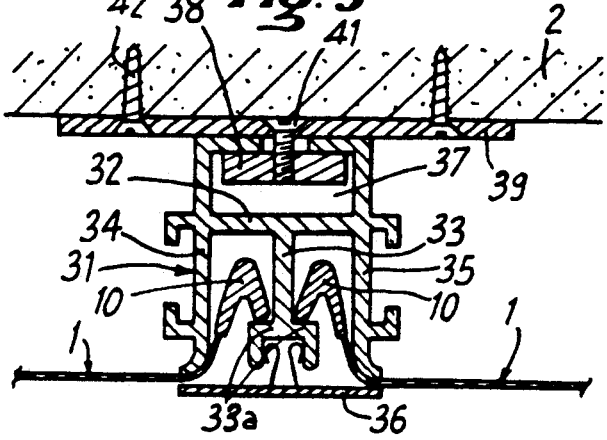
FIG. 5 is a view in vertical, transverse section of a double rail fixed to the ceiling of a room.

In the variant embodiment shown in FIG. 5, the false ceiling comprises two coplanar horizontal taut sheets 1 which are fastened to the same double rail 31 fixed beneath the ceiling 2 or on a reinforcing piece of adequate section. This double rail 31 comprises an upper horizontal web 32 which is downwardly extended by a vertical central flange 33 and two other vertical flanges 34, 35, of greater height, located on either side of the central vertical flange and at a distance therefrom. The central vertical flange 33 bears at its lower end two shoulders 33*a* extending horizontally on either side of the flange 33, respectively in the direction of the two flanges 34, 35, and serving to retain the harpoons 10 constituting the borders of the two sheets 1. The two vertical flanges 34, 35 terminate, at their lower ends, in rounded parts beneath which pass the sheets 1 as in the case of the embodiment of FIG. 1. A decorative piece 36 may be fixed, for example by clipping, to the lower end of the central flange 33 in order to close the lower part of the rail 31, i.e. the space between the two curved parts of the two sheets 1.

In its upper part, the rail 31 comprises an upwardly open C-shaped groove 37 in which is housed a small bar 38. Above the rail 31 extends a horizontal fixing plate 39 which is rendered fast with the bar 32 by means of screws 41 traversing the fixing plate 39 and screwed in the bar 38. By screwing screws 41, the fixing plate 39 is thus rendered fast with the rail 31. This fixing plate 39 is in turn fixed to the ceiling 2, for example by means of screws 42.

Figure 6:
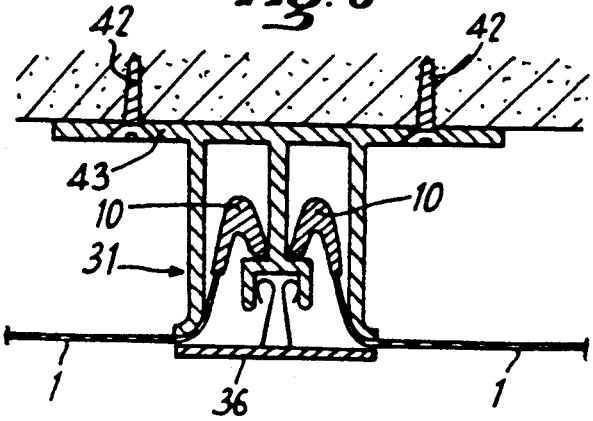
FIG. 6 is a view in vertical, transverse section of a variant embodiment of a double rail fixed to the ceiling of a room.

FIG. 6 shows a variant embodiment of the rail 31 in which the latter forms one piece, in its upper part, with a fixing plate 43 fixed to the ceiling by means of screws 42.

Figure 7:
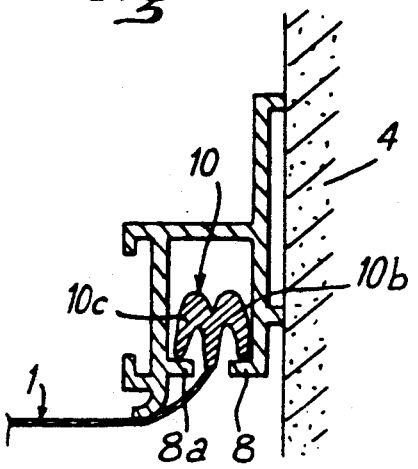
FIG. 7 is a view in vertical, transverse section of a variant embodiment of a rail adapted to be used with a border in the form of a double harpoon.

In the variant embodiment shown in FIG. 7, the border of the sheet 1 is constituted by a double harpoon 10 with two opposite arms 10*b*, 10*c* forming two hooks abutting respectively on the shoulder 8 provided at the lower end of the outer vertical flange 5 of the rail 3 according to FIG. 1, and on another shoulder 8*a* provided in the lower part of the inner vertical flange 7 and extending in the direction of the first shoulder 8, at the same level as the latter. The sheet 1 is fastened by introducing the double harpoon 10 in the space between the two shoulders 8, 8a.

Figure 8:
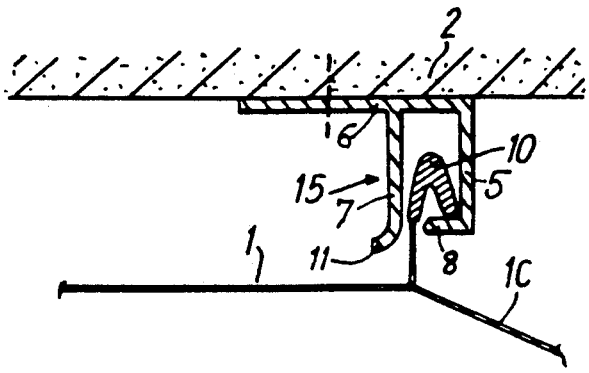
FIG. 8 is a view in vertical, transverse section of a variant embodiment of a rail holding a horizontal sheet also forming an inclined panel.

FIG. 8 illustrates the use of a rail 15 for fixing a false ceiling comprising a horizontal sheet 1 and an inclined panel 1C. In that case, the sheet 1 and the inclined panel 1C are connected in common to the same harpoon 10 retained by the rail 15.

Figure 9:
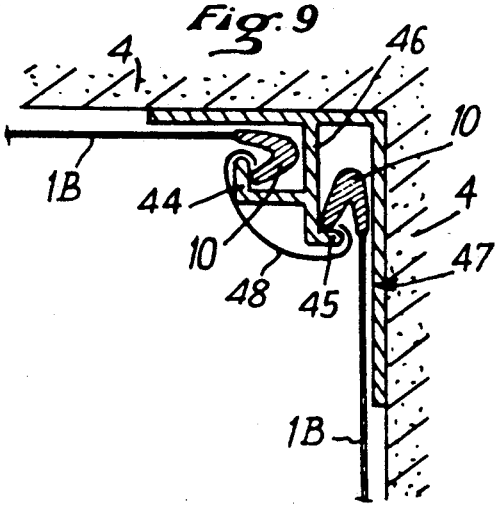
FIG. 9 is a view in horizontal, transverse section of a vertical rail fixed in the corner of a wall for holding a false wall.

FIG. 9 illustrates the fixing, in the angle formed by two walls, of the vertical borders 10 of two independent vertical taut sheets 1B forming two false walls. In that case, the two independent taut sheets 1B are respectively fastened, by their vertical borders in the form of harpoons 10, on respective shoulders 44 and 45 of a vertical rail 47 in the form of a bracket. These shoulders extend respectively in the direction of the two perpendicular flanges of the rail 47 and at a distance therefrom, and they are provided on an arm 46 issuing from a flange of the vertical bracket 47 fixed in the angle of the two walls 4. An added decorative piece 48 may be fixed on the rail 47 in order to hide it.

Figure 10:
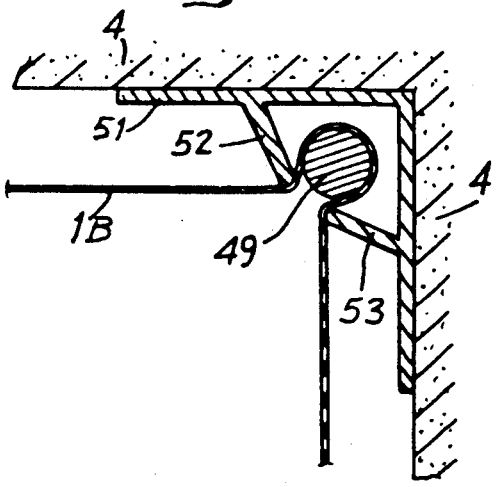
FIG. 10 is a view in horizontal, transverse section of a variant embodiment of a vertical rail fixed in the corner of a wall.

FIG. 10 illustrates a variant embodiment of the mode of fixing, in the angle made by two walls, a single vertical sheet 1B constituting a false wall in a room. In that case, the sheet 1 passes around a vertical rod 49 retained in a rail 51 in the form of a bracket fixed in the angle of the wall. This rail 51 comprises two inclined arms 52, 53 forming shoulders extending one towards the other and towards the interior of the room and defining therebetween a relatively narrow passage for the rod 49, whilst allowing this rod 49 to be retained between the arms 52, 53 and the bracket 51.

Figure 11:
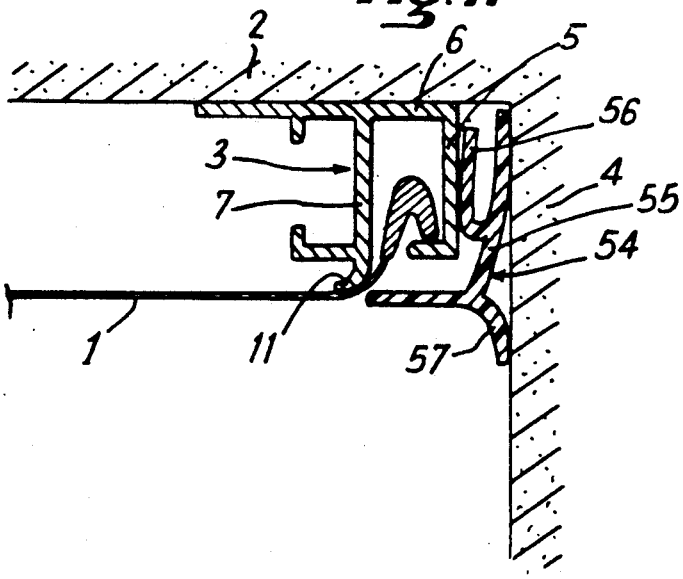
FIGS. 11 to 15 are views in vertical, transverse section of other variant embodiments of rails fixed to the upper part of a wall, for fastening a false ceiling and/or false wall.

In the variant embodiment shown in FIG. 11, the gap appearing at the lower part of the rail 3 is closed by an added finishing cover 54 which comprises an upwardly extending upper flange 55 which is engaged between the outer vertical flange 5 of the rail 3 and the wall 4. This flange 55 bears a supple, elastic tongue 56 extending upwardly and forming a spring to maintain the cover 54 elastically clipped in the space between the flange 5 and the wall 4. The cover 54 further comprises a curved lower part 57, offering the appearance of a trim and which establishes a connection between the point of abutment 11 of the sheet 1 and the wall 4.

Figure 12:
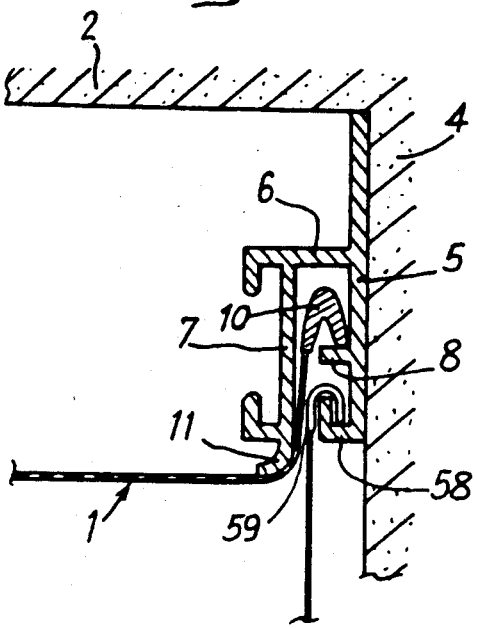

In the variant embodiment of the invention shown in FIG. 12, the projections 12 do not exist on the vertical flange 5 and the latter is applied in direct contact on the wall 4. There is therefore no ventilation in the upper part. Furthermore, the flange 5 extends below the shoulder 8 and terminates, at its lower end, in an upwardly open trough 58. In this trough 58, hooks 59 connected to wires for suspending paintings or other objects, may be hooked.

Figure 13:
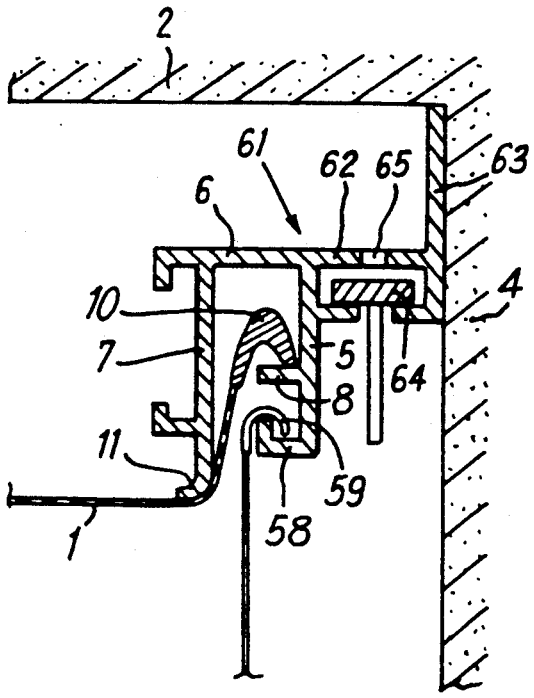

In the variant embodiment of the invention shown in FIG. 13, the rail 61 comprises an inner part similar to rail 3 of FIG. 1 and the upper horizontal web 6 of this inner part is extended horizontally in the direction of the wall by a horizontal web 62 joining a vertical flange 63 fixed to the wall, the extension 62 of the horizontal web 6 constituting the upper wall of a downwardly open C-shaped groove which constitutes a rail with one or more slideways for rollers 64 from which curtains, paintings, etc.. may be suspended. The horizontal web 62 may be pierced with ventilation holes 65.

Figure 14:
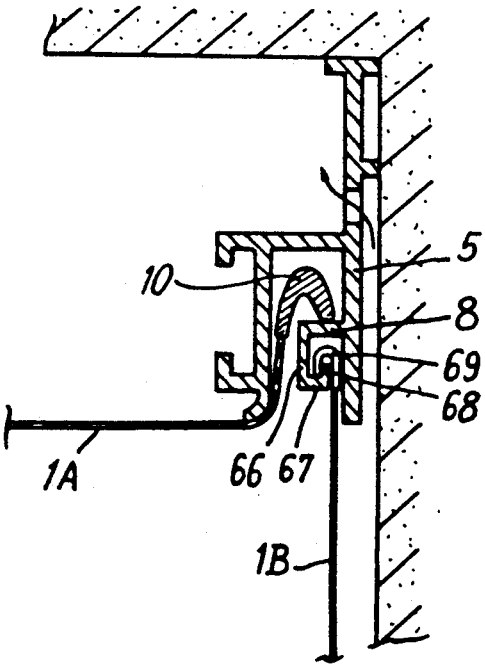

The variant embodiment of the rail shown in FIG. 14 is designed for the fastening of two independent taut sheets, namely a horizontal sheet 1A constituting a false ceiling and a vertical sheet 1B constituting a false wall. In that case, the harpoon 10 of the horizontal sheet 1A is hooked on the shoulder 8 which is in turn extended downwardly by a vertical flange 66 followed by a horizontal flange 67 extending in the direction of the vertical flange 5 and terminating in an upwardly extending additional shoulder 68. On this shoulder 68 is hooked a harpoon 69 extending towards the interior and downwardly open, which constitutes the upper border of the vertical taut sheet 1B.

Figure 15:
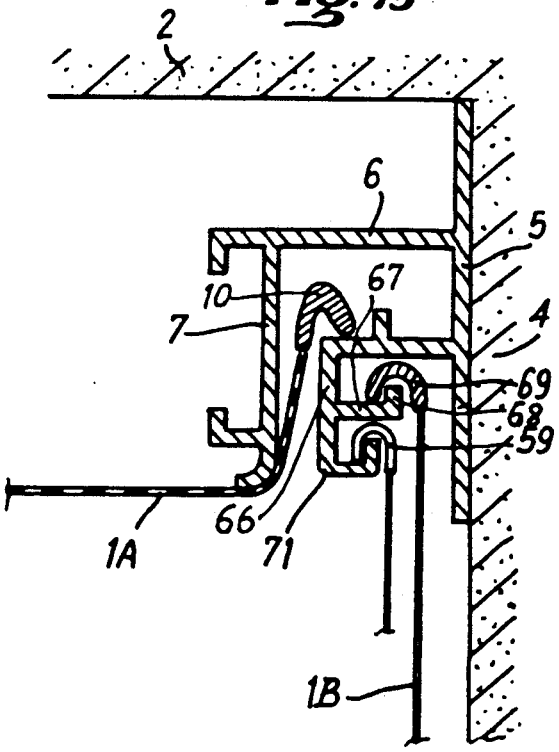

FIG. 15 shows a variant embodiment of the rail of FIG. 14, in which this rail comprises, below the additional shoulder 68, an upwardly open groove 71 joined to the vertical flange 66. In this groove 71, hooks 59 for suspending paintings or other objects may hook.

What is claimed is:

1. In a false ceiling for a room having walls;

a support comprising a continuous rail adapted to be fixed to a wall forming the exterior of a room;

said rail comprising first and second spaced vertical flanges each having different heights;

said first flange being smaller in extent in a first direction than said second flange, a first shoulder coupled with an end of said first flange, extending in the direction of said second flange towards the interior of the room and spaced from said second flange;

said first and said second flanges forming a recess therebetween;

said second flange having a curved end forming a second shoulder spaced from said first shoulder and extending vertically below said first shoulder in said first direction; and a taut sheet adapted to be fastened along its edges to said continuous rail and including a border along said edges of said sheet in the form of a hook or a "harpoon";

said first shoulder extending in a direction horizontally towards said second flange and stopping at a distance therefrom in order to define between said second flange and said first shoulder, a passage allowing the introduction of said harpoon upwardly past said first shoulder into said recess so that said harpoon can fasten into said first shoulder in simple abutment thereon;

said sheet when installed abutting said second shoulder and extending below said first shoulder in said first direction beneath a lower end of said second flange and penetrating into said recess of said rail whereby to permit said sheet to slide on said second shoulder while being spaced from said first shoulder without being damaged, and said sheet adapted to be horizontally stretched and adapted to be deviated upwardly by penetrating into said recess; and said "harpoon" being dimensioned to be free of contact with said second shoulder to permit said sheet when installed to extend about said second shoulder in taut relationship therewith.

2. In the false ceiling of claim 1, wherein said rail comprises an upper horizontal web joining said first and said second flanges.

3. In the false ceiling of claim 2, wherein said first flange includes a portion extending in a second direction above said upper horizontal web and adapted to be fixed to an upper part of the wall.

4. In the false ceiling of claim 1, wherein said rail comprises, on an inner face of said second vertical flange, adapted to face towards the interior of the room, a C-sectioned groove.

5. In the false ceiling of claim 1, including a finishing clip in the form of a bracket adapted to be fixed to said rail for hiding a lower part of the rail.

6. In the false ceiling of claim 1, wherein said second shoulder is rounded.

7. In the false ceiling of claim 2, wherein said rail comprises on an inner face of the second vertical flange facing towards the interior of the room, a C-sectioned groove.

8. In the false ceiling of claim 3, wherein said rail comprises a C-sectioned groove on an inner face of the second vertical flange facing towards the interior of the room.

9. In the false ceiling of claim 2, wherein the lower end of the second vertical flange is rounded.

10. In the false ceiling of claim 3, including a finishing clip in the form of a bracket adapted to be fixed to the rail in order to hide a lower part of said rail.

11. In the false ceiling of claim 2, including a finishing clip in the form of a bracket adapted to be fixed to the rail for hiding a lower part of said rail.

12. In the false ceiling of claim 6, including a finishing clip in the form of a bracket adapted to be fixed to the rail for hiding a lower part of said rail.

13. In the false ceiling of claim 2, wherein said horizontal web is extended beyond said second vertical flange.

14. In the false ceiling of claim 2, wherein said first flange is extended beyond said horizontal flange in a second direction opposite to said first direction and has a projection turned towards the wall.

15. In the false ceiling of claim 13, wherein said rail comprises, on an inner face of the second vertical flange, a C-sectioned groove.

16. In the false ceiling of claim 14, wherein said rail comprises a C-sectioned groove on an inner face of the second vertical flange.

17. In the false ceiling of claim 13, wherein the lower end of the second vertical flange, is rounded.

18. In the false ceiling of claim 14, wherein the lower end of the second vertical flange is rounded.

19. In the false ceiling of claim 13, including a finishing clip in the form of a bracket adapted to be fixed to the rail in order to hide a lower part thereof.

20. In the false ceiling of claim 14, including a finishing clip in the form of a bracket adapted to be fixed to the rail for hiding a lower part of said rail.

* * * * *